United States Patent [19]

Getz et al.

[11] Patent Number: 4,498,580

[45] Date of Patent: Feb. 12, 1985

[54] LAMP BULB CARTON, AND RESULTING LAMP BULB PACKAGE

[75] Inventors: Edward J. Getz, Irvington, N.J.; Gerald T. Lombardi, Florida, N.Y.

[73] Assignee: North American Philips Electric Corp., New York, N.Y.

[21] Appl. No.: 457,789

[22] Filed: Jan. 13, 1983

[51] Int. Cl.[3] ..... B65D 85/42; B65D 81/02

[52] U.S. Cl. ..... 206/418; 206/485; 206/590; 206/592; 206/45.14; 229/39 B

[58] Field of Search ..... 206/418, 419, 422, 485, 206/521, 588, 590, 592, 593, 583, 591, 45.14; 229/39 B, 29 B, 29 C, 29 D, 29 F, 87 R; 217/27, 34

[56] References Cited

U.S. PATENT DOCUMENTS

| | | | |
|---|---|---|---|
| 1,110,571 | 9/1914 | Poulton | 229/39 B |
| 1,114,856 | 10/1914 | Bussey | 217/34 |
| 1,115,270 | 10/1914 | Arnold | 217/34 |
| 1,182,664 | 5/1916 | Evers | 217/34 |
| 1,222,769 | 4/1917 | Thayer | 217/27 |
| 2,451,806 | 10/1948 | Carson | 206/45.14 |
| 2,609,136 | 9/1952 | Sider | 206/521 |
| 2,714,981 | 8/1955 | Leavens | 206/583 X |
| 3,062,367 | 11/1962 | Holy | 229/39 B |
| 3,240,417 | 3/1966 | Andreini | 206/588 X |
| 3,547,256 | 12/1970 | Bolding | 229/39 B |
| 3,693,866 | 9/1972 | Struble | 229/39 B |
| 3,820,707 | 6/1974 | Fischer et al. | 229/39 B |
| 3,941,304 | 3/1976 | Barbierr et al. | 229/39 B |
| 3,968,924 | 7/1976 | Tyrseek | 229/39 B |
| 4,109,786 | 8/1978 | Roccaforte | 206/45.19 |
| 4,185,766 | 1/1980 | Davidson et al. | 229/39 B |
| 4,231,510 | 11/1980 | Beard | 229/39 B |

*Primary Examiner*—Allan N. Shoap
*Assistant Examiner*—Bryon Gehman
*Attorney, Agent, or Firm*—Rolf E. Schneider

[57] ABSTRACT

An electric lamp bulb (or similar fragile article) is retained in suspended centralized position within a collapsible open-ended carton of rectangular sleeve-like configuration by a dual-panel liner that extends across the interior of the carton and has apertured medial parts which nestingly receive and interlock with the bulbous portion of the lamp bulb. Each of the liner-panels has a pair of hinged flaps that swing in opposite directions and are displaced in criss-cross fashion by the bulbous part of the lamp bulb to form a single aperture in the associated liner-panel and a pair of cradle-like structures. The hinged flaps are so shaped and dimensioned that their free ends are pressed against the adjacent walls and diagonally-opposite corners of the carton by the inserted lamp bulb and thus produce buttressing forces which not only counteract the natural tendency of the carton to collapse but lock the carton in its erected form. The resulting self-erecting and self-squaring features permit the carton to be automatically set-up and loaded in a very efficient and reliable manner by automated lamp-packaging machines and the resulting lamp bulb packages to be readily stacked on store shelves.

7 Claims, 4 Drawing Figures

LAMP BULB CARTON, AND RESULTING LAMP BULB PACKAGE

BACKGROUND OF THE INVENTION

This invention relates to the packaging art and has particular reference to an improved carton for packaging an electric lamp bulb, and to the improved lamp bulb package which results from the use of such carton.

It is customary in the electric lamp industry to package lamp bulbs by placing them in suitable containers which protect the bulbs from breakage and damage during shipment and also during display for purchase at the retail level. In the case of incandescent type lamps, this is generally accomplished by inserting the individual lamp bulb into a sleeve-like carton of rectangular cross-section that is fabricated from cardboard and is open at both ends. Retention of the lamp bulb in its inserted position within the carton is achieved in accordance with the prior art by various kinds of partitions that constitute integral parts of the carton and have apertures which interlockingly receive the enlarged or bulbous portion of the lamp.

For example, a paperboard carton for packaging a light bulb or similar fragile article that is of tubular sleeve-like configuration and has a pair of partition panels with openings which accommodate the bulbous portion of the inserted lamp and that also has a pair of tab portions which are located at one or both ends of the panels and lock the carton in its fully open and squared configuration is disclosed in U.S. Pat. No. 3,547,256 to Bolding. A lamp bulb carton of similar construction which has an internal partition structure formed by a pair of panels each having a pair of short flaps which resiliently grip the body portion of the inserted light bulb is disclosed in U.S. Pat. No. 3,820,707 to Fischer et al. The use of a pair of internal partition members each having a single opening and a single hinged flap for retaining and protecting the bulbous portion of an inserted lamp bulb is disclosed in U.S. Pat. No. 3,968,924 to Tyrseck.

A carton designed for packaging a pair of lamp bulbs which are separated from one another and locked within the carton by means of a partition structure that has suitable cut-outs and bulb-separating tabs or flaps is disclosed in U.S. Pat. Nos. 4,185,766 (Davidson et al.) and 4,231,510 (Beard).

A single-lamp carton which has an apertured panel that obliquely spans a corner of the erected carton and, in addition to locking the inserted lamp bulb in place, provides a bracing action that holds the open-ended carton in erected position is disclosed in U.S. Pat. No. 3,941,304 to Barbieri et al.

While the prior art cartons were generally satisfactory from the standpoint of retaining the lamp bulb or other article in its inserted position within the open-ended sleeve, they did not provide adequate protection for the packaged lamp and/or completely solve the problem created by the natural tendency of the loaded carton to return to its collapsed and flat condition. Most of the prior art cartons were also complicated and expensive to mass-produce and had to be set-up for loading by hand. These are important deficiencies, particularly in the case of lamp bulbs and similar articles that are packaged by automated equipment at high production speeds rather than by manual labor and must be stacked on store shelves or display units.

The aforementioned drawbacks are overcome in accordance with the present invention by making a single-lamp carton from suitable boxboard or the like that is cut and scored in such a manner that the inserted lamp bulb is not only securely held in place within the carton by a pair of apertured partition panels that provide an internal liner but coact with paired flaps which are coined from medial parts of the respective panels and are so shaped and arranged that they swing in opposite directions and form cradle-like structures that are pushed by the inserted lamp bulb into pressured engagement with the adjacent walls of the carton. One of the flaps in each pair is also of such length that it extends into and engages a corner-forming portion of the carton, such flaps being so oriented that they engage diagonally-opposite corners of the erected carton. The "criss-crossed" displacement of the paired flaps into cradle-like position, coupled with the forces which they generate by being pressed against the walls and corners of the carton, automatically centers the inserted lamp bulb in suspended position within the carton and locks the carton in fully erected "square" configuration. These self-centering and self-squaring features permit the carton to be erected and loaded with a lamp bulb in a very efficient manner by automatic high-speed packaging machines and provide lamp packs that can be readily stacked.

BRIEF DESCRIPTION OF THE DRAWINGS

A better understanding of the invention will be obtained from the exemplary embodiment shown in the accompanying drawings, wherein.

DESCRIPTION OF THE PREFERRED EMBODIMENT

While the improved carton can be employed to protectively package various kinds of fragile articles that have an enlarged or bulbous portion, it is especially adapted for use in conjunction with packaging incandescent type electric light bulbs and it has accordingly been so illustrated and will be so described.

Figure 3:
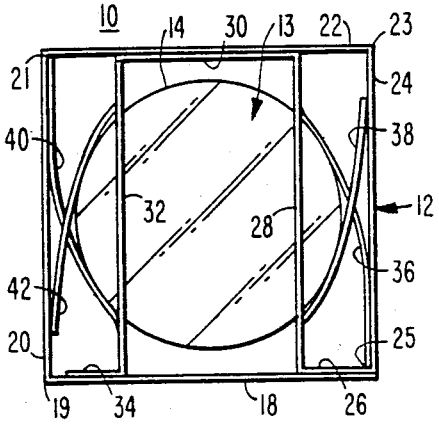
FIG. 3 is a plan view into the open end of the lamp bulb package illustrating the manner in which the cradle-like structures formed by the displaced buttressing flaps center the light bulb in suspended position within the carton.
Figure 1:
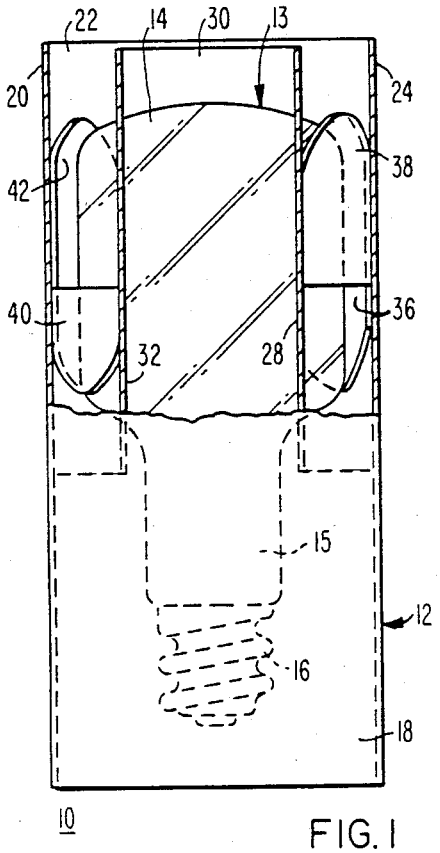
FIG. 1 is a front elevational view of a lamp bulb package that embodies the present invention, a portion of one of the carton walls being removed to illustrate the manner in which the hinged flaps of the dualpanel liner are pushed into pressured buttressing engagement with the carton walls by the inserted lamp bulb.
Figure 2:
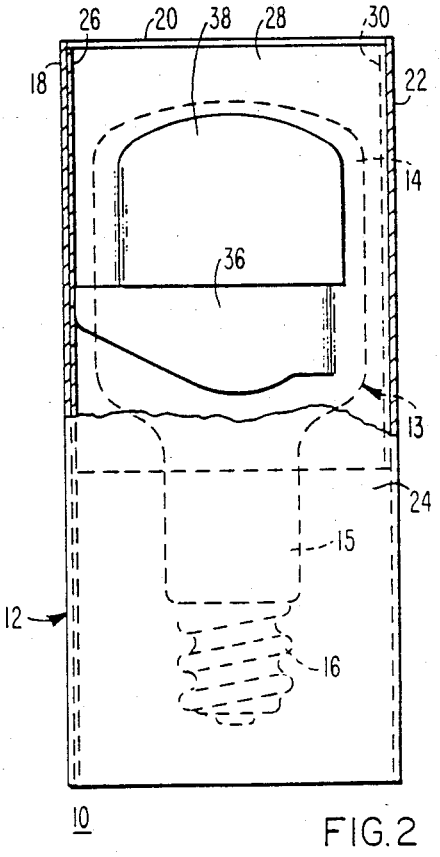
FIG. 2 is a side-elevational view of the lamp bulb package, a portion of the carton wall again being removed to provide a full view of one of the liner panels and its pair of buttressing flaps.

As shown in FIGS. 1–3, the improved lamp package 10 provided by the present invention comprises a carton 12 that is open at both ends and protectively encloses an electric light bulb 13. The lamp bulb 13 is of the incandescent type and has a glass envelope 14 of bulbous configuration that is terminated by a neck portion 15 which is fitted with a suitable base member 16, such as the screw type base shown. As will be noted, particularly in FIG. 3, the carton 12 constitutes a sleeve of square cross-section that is defined by four walls 18, 20, 22 and 24 which are hingedly interconnected with one another and are of the same size and shape so that the carton can be collapsed for bulk shipment to the lamp factory. The carton 12 is preferably fabricated from a single piece of boxboard or other suitable stiff paperboard material that is foldable along score lines 19, 21, 23 and 25 which extend along the four corners of the carton when it is in fully-erected and square configuration. The lamp bulb 13 is held in suspended and spaced-apart relationship with the carton walls by means of a partition-like liner that consists of two panels 28 and 32 which extend across the interior of the carton 12 (in parallel-spaced relationship) and along about half the length of the carton from one of its open ends. The liner-panels 28, 32 are held in such position by tabs 26, 30 and 34 that constitute parts of the carton blank and are glued or otherwise fastened to opposite walls 18, 22 of the carton 12, as best shown in FIG. 3. Medial parts of each of the liner-panels 28, 32 are suitably cut and scored to provide two pairs of hinged flaps 36, 38 and 40, 42 that swing in opposite directions and, when displaced from their respective panels, form a single aperture in each of the panels that nestingly accommodates and interlocks with the bulbous part of the lamp envelope 14.

As will also be noted in FIG. 3, the size relationship of the lamp bulb 13 and the carton 12 is such that the inserted bulb pushes the paired flaps 36, 38 and 40, 42 outwardly in criss-cross fashion so that the free ends of the flaps are in pressured engagement with the adjacent side walls 20, 24 of the carton—thus not only exerting buttressing forces on opposite walls of the carton 12 along its corners that keep the carton in its fully-erected configuration but forming "cradle-like" structures that resiliently press against and frictionally grip the circular cross-sectional bulbous part of lamp envelope 14. The resulting interaction between the displaced buttressing flaps 36, 38 and 40, 42 and the adjacent walls 20, 24 of the carton 12 automatically centers the lamp bulb 13 within the carton and keeps the liner-panels 28, 32 in parallel-spaced position and frictionally-interlocked relationship with the bulb.

Another important feature of the invention is the manner in which the paired buttressing flaps 36, 38 and 40, 42 counteract the natural tendency of the expanded carton 12 to return to its original collapsed condition. This is achieved by making one flap in each pair of flaps of such length that they extend into and abuttingly engage diagonally-opposite corner portions of the erected carton. In the illustrated embodiment as viewed in FIG. 3, the corner-engaging lengthened flaps are flaps 36 and 40. The resulting self-erecting and self-squaring features provided by the unique flap and liner-panel assembly of the improved carton 12 permit the carton to be efficiently and reliably set up and loaded at high speeds by automated lamp-packaging machines and the resulting lamp bulb packages to be readily stacked on store shelves.

Figure 4:
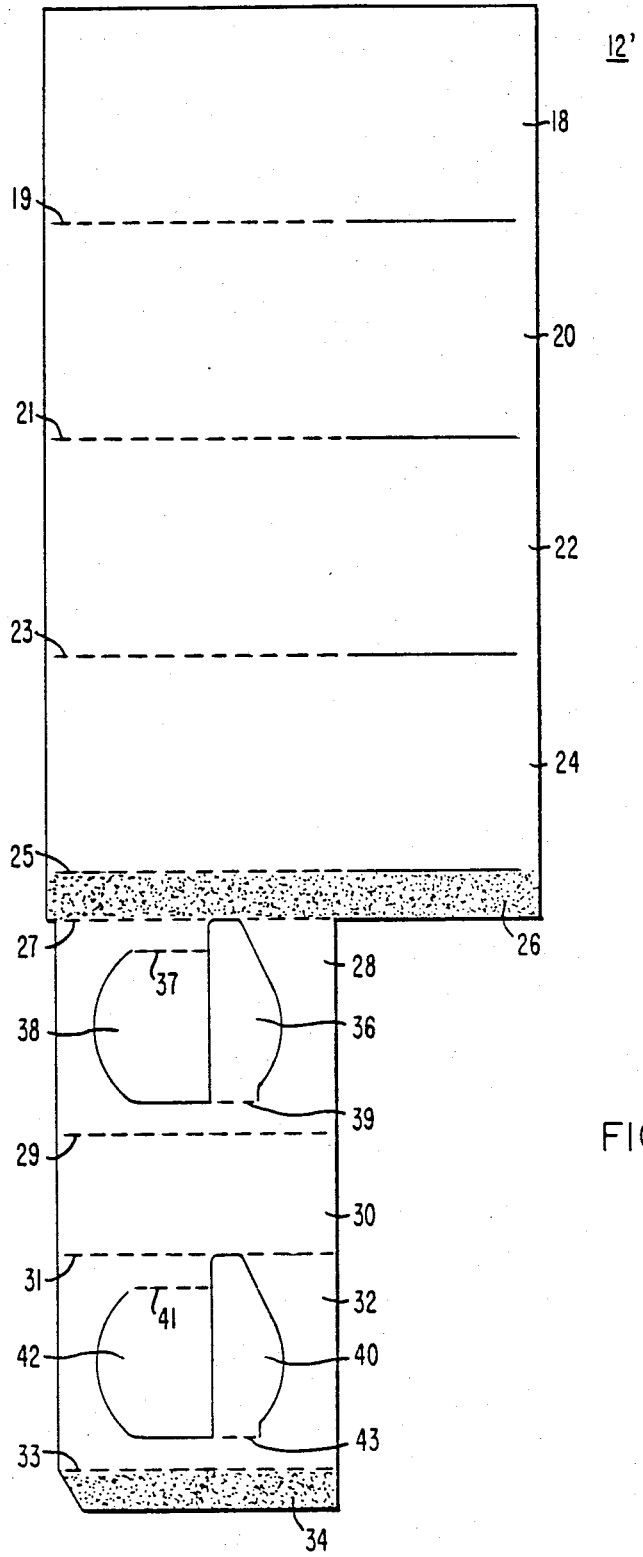
FIG. 4 is a plan view, on a reduced scale, of the boxboard blank from which the carton is formed.

The improved carton is preferably fabricated from a single piece of packaging material that is suitably cut and scored to form a blank 12′ shown in FIG. 4. As illustrated, the blank consists of a large rectangular portion that is divided into four wall segments 18, 20, 22 and 24 by the parallel score lines 19, 21, 23 and 25. A glue tab 26 at one end of the large rectangular portion is hingedly joined by another parallel score line 27 to a smaller rectangular portion that is divided into panels 28, 30 and 32 and another glue tab 34 by a second series of parallel score lines 29, 31 and 33. Panel 30 is also a glue panel even though it is not dappled to indicate this function (the adhesive being placed on the underside of the panel, as it is viewed in FIG. 4). Panels 28 and 32 comprise the short partition or liner panels and accordingly are cut to provide the two pairs of oppositely-hinged buttressing flaps 36, 38 and 40, 42 that are displaceable in criss-cross fashion from the planes of the respective liner-panels along score lines 37, 39 and 41, 43 which extend along opposite longitudinally-extending side portions of the associated liner-panel.

As indicated by the solid-line portions of the scores 19, 21, 23 and 25, the blank 12′ can be partially slit through in these regions to make it easier for the collapsed carton to be expanded into rectangular sleeve configuration and also to reduce the forces that act to restore the expanded carton to its original flat condition.

Assembly of the blank 12′ into sleeve or carton form is achieved by first folding it along score lines 23, 25, 27, 29, 31 and 33 in successive steps so that the adhesive-coated face of glue panel 30 overlies and is secured to the matching portion of wall segment 22 and the liner-panels 28, 32 are in upstanding parallel position with glue tabs 26, 34 extending laterally and parallel to wall segment 22. The remaining wall segments 20 and 18 are then swung around and over the upstanding liner-panels 28, 32 by successively folding the blank 12′ along score lines 21, 19—thus forming the tubular carton 12 which is held in such configuration by securing the glue tabs 26, 34 to the overlapping edge portions of wall segment 18.

We claim:

1. A carton for packaging an electric lamp bulb, which comprises four interconnected walls of paperboard defining a collapsible open-ended tubular sleeve; and internal liner means for protectively retaining a lamp bulb inserted into said sleeve and concurrently maintaining the sleeve in erect tubular form, said liner means including a pair of liner-panels hingedly connected to one set of oppositely disposed walls of the sleeve, said liner-panels being disposed in side-by-side spaced-apart relationship with each other and with the other set of oppositely disposed walls of said sleeve when the sleeve is in erect tubular form and thereby providing a dual-partition-like liner extending longitudinally within the sleeve and across the interior thereof; each liner-panel having a pair of flaps hinged to opposite longitudinally extending side portions of the associated liner-panel and swingable in criss-cross fashion along arcuate paths from the plane of the associated liner-panel toward the respective adjacent wall of the sleeve; both pairs of flaps being so shaped and arranged that, when displaced from the respective planes of the liner-panels, they provide cradle-like structures and a single opening in each liner-panel adapted to nestingly receive and effect a frictional interlock with the bulbous portion of the lamp bulb inserted into the sleeve and between the liner-panels; said flaps also being of such length that, when in displaced cradle-like position within the erected sleeve, the free end portions of the flaps are in pressured engagement with the respective adjacent walls of the sleeve along locations proximate different corners of the sleeve and exert buttressing forces on the sleeve walls at such locations to counteract the inherent tendency of the sleeve to collapse; one of the flaps in each pair of flaps being longer than the other flap in the pair, said longer flaps being so oriented that they extend into and engage corner portions of the erected sleeve diagonally opposite one another and thus also serve to lock the sleeve in erect tubular form.

2. A carton according to claim 1, in which the other flap in each pair of flaps is wider than said one flap in the pair.

3. A carton according to claim 1, in which the four walls of the sleeve have substantially the same width, the sleeve thus having a substantially square cross section in its erect tubular form.

4. A carton according to claim 1, in which the dual-partition-like liner is shorter in length than the sleeve and extends longitudinally within the sleeve from one end thereof.

5. A carton according to claim 1, in which the four walls of the sleeve and the pair of liner-panels constitute parts of a single piece of cut and scored paperboard.

6. An electric lamp bulb package, which comprises an electric lamp bulb having a bulbous-shaped portion; and a collapsible paperboard carton of open-ended tubular configuration snugly enclosing said lamp bulb and having an internal lining means in interlocked relationship with the bulbous-shaped portion of the lamp bulb for retaining the lamp bulb within the carton, said carton having four interconnected walls defining a rectangular cross section when fully erected; said liner means being constituted by a pair of liner-panels extending across the carton interior and joined to one set of oppositely disposed walls of the carton and spaced inwardly from the other set of oppositely disposed walls of the carton; each liner-panel having a pair of flaps hinged to opposite side portions of the associated liner-panel and swingable in opposite directions from the plane of said associated liner-panel in criss-cross fashion toward the adjacent carton wall, the pairs of flaps being so arranged and shaped that they form a single opening in each liner-panel and a pair of cradle-like structures when the flaps are displaced outwardly from the planes of the liner-panels; the bulbous-shaped portion of the lamp bulb being disposed between said pair of liner-panels and displacing both pairs of flaps outwardly toward the adjacent walls of the carton and thus protruding into the openings formed in the liner-panels by the displaced flaps so that the packaged lamp bulb is in nested interlocked relationship with the liner-panels; the displaced criss-crossed flaps being of such length that they are in pressured engagement with the respective adjacent walls of the carton and exert buttressing forces thereon to counteract the inherent tendency of the carton to collapse; one of the flaps in each pair of flaps being longer than the other flap in the pair, said longer flaps in their displaced position being so oriented that they engage corner portions of the carton diagonally opposite one another and thereby serve to maintain the carton in fully erected form.

7. A package according to claim 6, in which the four walls of the carton have substantially the same width, the carton thus having a substantially square cross section in its fully erected form.

* * * * *